US012053038B1

(12) United States Patent
Aiken

(10) Patent No.: US 12,053,038 B1
(45) Date of Patent: Aug. 6, 2024

(54) SOLAR ARM SHIELD WITH AIR FIN

(71) Applicant: John Edward Aiken, Monroeville, PA (US)

(72) Inventor: John Edward Aiken, Monroeville, PA (US)

( * ) Notice: Subject to any disclaimer, the term of this patent is extended or adjusted under 35 U.S.C. 154(b) by 0 days.

(21) Appl. No.: 18/601,249

(22) Filed: Mar. 11, 2024

Related U.S. Application Data

(60) Provisional application No. 63/451,514, filed on Mar. 10, 2023.

(51) Int. Cl.
*A41D 13/08* (2006.01)

(52) U.S. Cl.
CPC ..... *A41D 13/08* (2013.01); *A41D 2300/32* (2013.01); *A41D 2400/26* (2013.01)

(58) Field of Classification Search
CPC ..... A41D 13/08; A41D 27/12; A41D 27/10
USPC ..... 2/16
See application file for complete search history.

(56) References Cited

U.S. PATENT DOCUMENTS 713,239 A * 11/1902 Peterson
4,183,098 A * 1/1980 Knowles, Jr. ..... A63B 69/0046 473/213
5,056,157 A 10/1991 Pryor
5,163,678 A * 11/1992 Rogers ..... A63B 69/0046 473/59
5,357,633 A 10/1994 Rael
5,662,594 A * 9/1997 Rosenblatt ..... A61F 5/013 2/2.5
5,715,535 A * 2/1998 Hamilton ..... A41D 13/08 2/46
5,974,586 A 11/1999 Reinoso
6,098,208 A * 8/2000 Cordon ..... A63B 71/1225 2/22
6,240,565 B1 * 6/2001 Spear ..... A41D 13/08 2/81
6,775,844 B1 * 8/2004 Castillo ..... A41D 13/08 2/16
7,389,544 B1 * 6/2008 Biggerstaff ..... A41D 13/08 2/16
7,694,348 B1 * 4/2010 Smith ..... A41D 13/04 2/16
2010/0083415 A1 8/2010 Beckford

FOREIGN PATENT DOCUMENTS

CA 3013903 A1 * 2/2019 ..... A61F 15/004

* cited by examiner

*Primary Examiner* — Tajash D Patel

(57) ABSTRACT

A solar radiation arm shield includes an elongated semi-rigid shell of a UV radiation-blocking material defining first and second side edges. In addition, the arm shield includes a hinged air deflection baffle angled relative to a longitudinal edge of the elongated semi-rigid shell. Preferably included is padding on the exterior of a portion of the elongated semi-rigid shell.

7 Claims, 1 Drawing Sheet

SOLAR ARM SHIELD WITH AIR FIN

CROSS REFERENCE TO RELATED APPLICATION

This patent application is related to and claims priority from U.S. Provisional Patent Application Ser. No. 63/451,514 filed Mar. 10, 2023.

FIELD OF THE INVENTION

The present invention relates, in general, to skin protection from solar radiation, and, more particularly, this invention relates to sun-blocking arm shields for vehicle drivers and others.

BACKGROUND OF THE INVENTION

Prior to the conception and development of the present invention, truck and car drivers who like to drive with an arm resting along an open window during warm weather have been in jeopardy of sun burn or other skin damage from solar radiation. Wearing long sleeves may provide sun protection, but is an unacceptable answer in hot weather. In hot weather with no vehicle air conditioning, it is also desirable to have greater outside air flow across the driver's face and neck.

PRIOR ART

Several U.S. patents have disclosed sunburn protection for arms hanging along a window edge, including U.S. Pat. Nos. 5,056,157, 5,357,633, and 5,974,586, all three disclosing flexible fabric arm sleeves. U.S Publication number 2007/0028345 discloses a driving sleeve. These all provide a flexible fabric sleeve covering various portions of the arm, hand, and shoulder. Castillo in U.S. Pat. No. 6,775,844 discloses an arm shade apparatus with end-mounted elastic bands and a special hood for covering the hand. All of the above tend to trap heat and moisture within the sleeve and be uncomfortable, and also are cumbersome to put on and take off. Biggerstaff in U.S. Pat. No. 7,389,544 discloses an adjustable length arm shade for the forearm which includes a special swivel joint for movement of the shade. These features add considerably to the complexity, and hence the manufacturing cost. Beckford in US patent application 2010/000834 discloses a driver's sun shield that straps onto the arm, but with no external padding or other external features.

SUMMARY OF THE INVENTION

The present invention provides a vehicle driver arm shield for solar protection and greater comfort including an elongated C-shaped substantially rigid shell of a UV radiation-blocking material defining first and second side edges. There is at least one releasable attachment strap with separate engageable portions fixedly attached to each of the first and second side edges proximal the ends for removable attachment to a user. In addition, the arm shield includes padding on the exterior of a portion of the rigid shell and a hinged air-deflection fin to direct more cooling air to the driver.

OBJECTS OF THE INVENTION

It is, therefore, one of the primary objects of the present invention to provide an inexpensive arm shield that can conveniently protect drivers from solar radiation yet still allowing air circulation around the arm.

Another object of the present invention is to provide solar protection from the forearms of vehicle drivers and also augment outside air flow to the driver from an open window.

Still another object of the present invention is to provide simple yet effective forearm shields which are easy to put on and take off.

Yet another object of the present invention is to provide an effective shield against the sun's rays on the forearm with comfort cushioning at the door sill.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
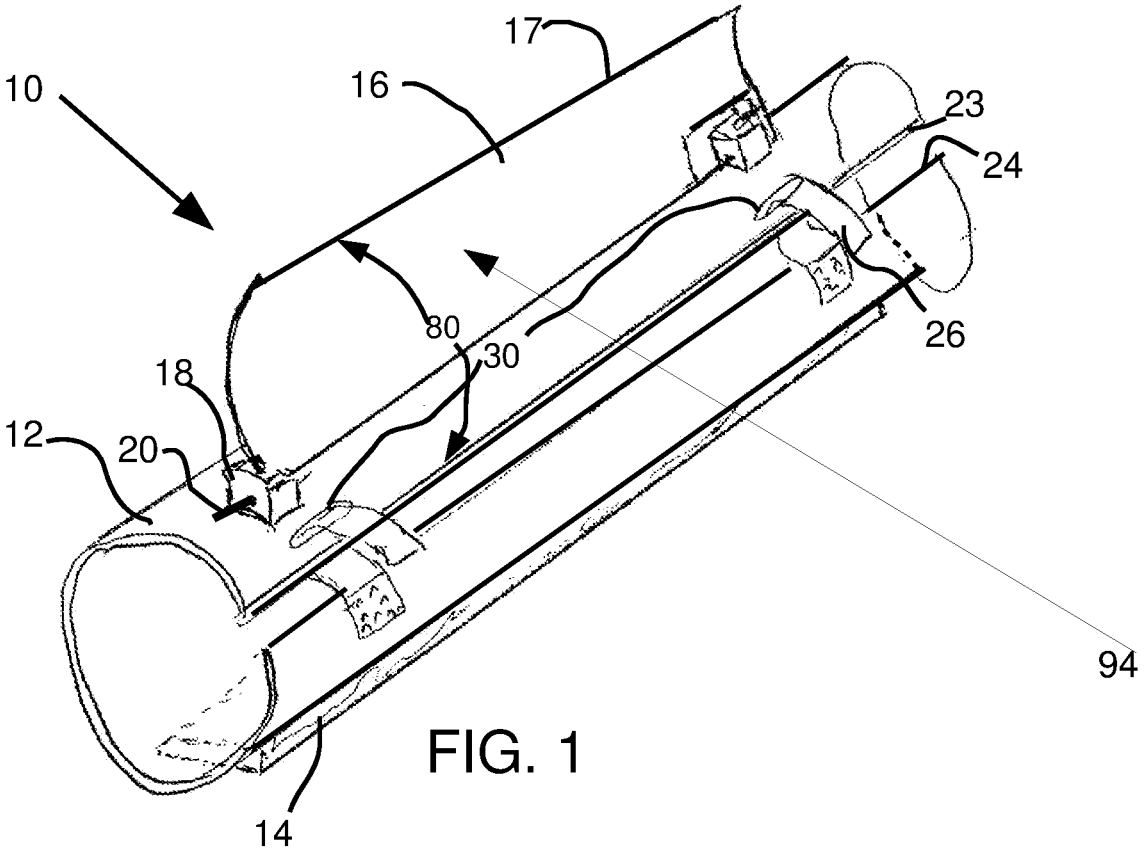
FIG. 1 is a perspective view of the present invention with a key element engaged.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, the present invention 10 is shown in a perspective view with a key element, the air deflection baffle 16 engaged. An elongated semi-cylindrical shell 12 is made generally of a resilient semi-rigid plastic to a length about equal to the forearm of a typical adult. Semi-rigid herein means it can be manually flexed, but will return to its original shape when released. The semi-cylindrical shell will encompass at least half the circumference of a typical person's forearm, and have a C-shaped end view. The plastic may be opaque, translucent, or tinted transparent, blocking a significant portion of the solar UV radiation. The semi-cylindrical shell 12 may optionally be colored; and optionally have logos or other indicia visible on the exterior surface. The relatively thin semi-cylindrical shell 12 defines two longitudinal edges 23 and 24. The semi-cylindrical shell 12 is preferably tapered slightly toward the front (wrist) end. The arm shield includes an air deflection baffle (air fin) 16 that is rotatable around a longitudinal pin 20 which is angled such as to deflect outside air inward while the vehicle is in motion with the window open. The angle 80 between a longitudinal edge of the air deflection baffle 16 and a longitudinal edge of the semi-cylindrical shell 23 is between 25 and 45 degrees. This angle is necessary so that the baffle can catch and direct air passing by toward the driver, who typically has the elbow hangs out the vehicle window while the wrist is on the window sill. When rotated up, the air-deflection baffle 16 is locked into position by sliding end edges rearward into slots (28 on FIG. 2) in the small cube-like blocks 18 fixed to the shell surface. Padding 24 on the exterior of a portion of the rigid shell enhances comfort. The air-deflection baffle can optionally be curved with a radius of curvature 94 between 36 and 46 centimeters so as to facilitate air deflection to the driver's head. For the comfort of the vehicle driver while resting the arm on the open window sill, at least one cushioning pad 14 is attached on the outer surface.

Figure 2:
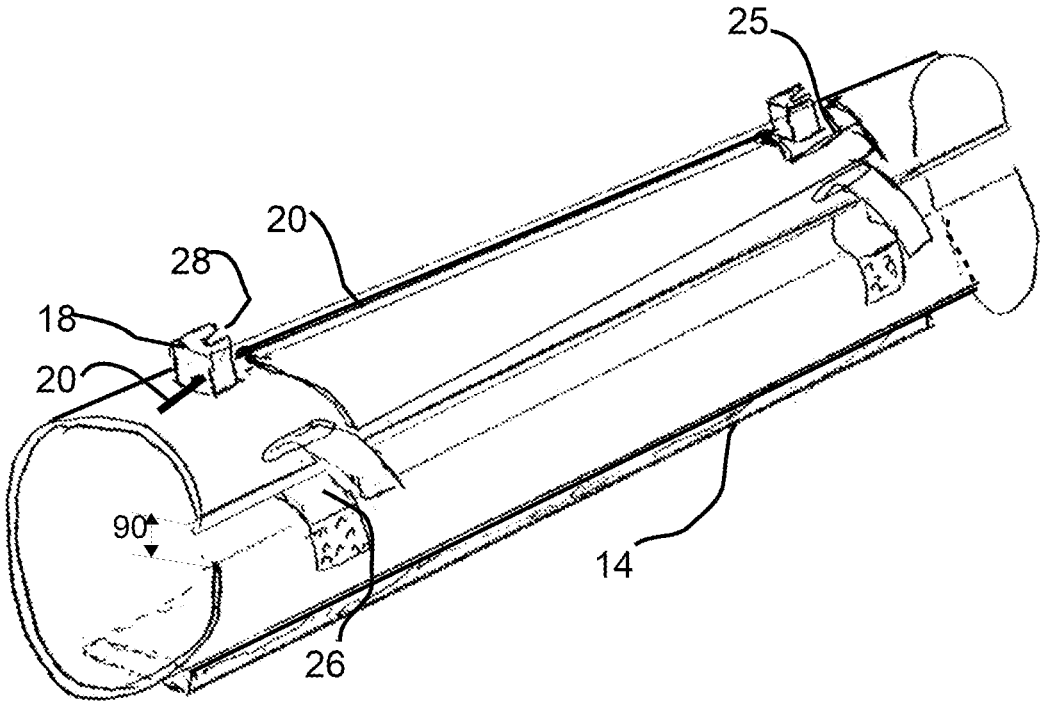
FIG. 2 provides a perspective view of the present invention with a key element in standby position.

FIG. 2 provides a perspective view of the present invention with a key element in standby position. The air-deflection baffle 16 has been disengaged from the two slotted blocks 18 by sliding forward out of the slots 28. A longitudinal rod 20 along the lower lateral edge and through the slotted blocks 18 facilitates sliding and rotation of the air-deflection baffle 16. To enable the air-deflection baffle 16 to slide a finite distance and engage with the slotted block 18 near the forward end, there is a notch 25 in the edge adjacent the longitudinal rod 20. The semi-cylindrical shell 12 is sized to extend from about the elbow to the wrist without totally encompassing the forearm. The shell 12 is semi-rigid rigid, which herein means that it is resilient and can flex somewhat to further open the gap between the longitudinal edges 23 and 24 to permit the arm to be inserted, or for the shell 12 to otherwise be placed onto the forearm. Unflexed, they are spaced apart by a gap of 1 to 4 centimeters. This configuration also allows the semi-cylindrical shell 12 with a C-shaped cross section to accommodate a wide range of arm sizes. The rigidity of the shell is significant in that it must support the slotted blocks 18, and in turn the longitudinal rod 20. Along one longitudinal edge 23 are preferably two attachment slots 30. At least two straps 26 are attached along the opposing side edge 24 proximal the ends. The side of the strap 26 facing out away from the arm is at least partially covered with hook and loop (Velcro®) material, which engages with at least the hook and loop material on the distal ends of the straps 26. After placement on the arm, the distal ends of the straps 26 are fed through the attachment slots 30 and folded back onto another portion of the hook and loop material 26 to hold the shell 12 in place at whatever tension is desired. The process is reversed for easy and quick removal. Other types of fasteners besides the Velcro® could optionally be used, such as elastic bands and studs.

While a presently preferred embodiment of the present invention has been described in sufficient detail above to enable a person skilled in the relevant art to make and use the same, it should be obvious that various other adaptations and modifications can be envisioned by those persons skilled in such art without departing from either the spirit of the invention or the scope of the appended claims.

I claim:

1. A vehicle driver arm shield comprising:

an elongated semi-cylindrical shell with two spaced-apart longitudinal edges;

at least one cushioning pad attached along an exterior of the elongated semi-cylindrical shell;

two spaced-apart slotted blocks fixed on an outer surface of the elongated semi-cylindrical shell; and, an elongated air deflection baffle rotatably attached to a portion of the exterior of the elongated semi-cylindrical shell at the two spaced-apart slotted blocks.

2. The vehicle driver arm shield of claim 1 wherein the air-deflection baffle has two longitudinal edges and at least one end edge, wherein the two longitudinal edges of the semi-cylindrical shell and the two longitudinal edges of the air-deflection baffle are not parallel with an angle between them of between 25 and 45 degrees.

3. The vehicle driver arm shield of claim 1 wherein the elongated air-deflection baffle has a radius of curvature between 36 and 46 centimeters.

4. The vehicle driver arm shield of claim 1 wherein a longitudinal pin is encompassed by one edge of the air-deflection baffle and operably connected to the two spaced-apart slotted blocks.

5. The vehicle driver arm shield of claim 1 wherein the two longitudinal edges of the semi-cylindrical shell are spaced apart in a range of 1 to 4 centimeters.

6. The vehicle driver arm shield of claim 1 wherein the semi-cylindrical shell is constructed of a semi-rigid plastic.

7. The vehicle driver arm shield of claim 1 wherein the semi-cylindrical shell is configured for securing with two hook and loop fastener straps.

* * * * *